US011162391B2

(12) United States Patent
Onishi et al.

(10) Patent No.: US 11,162,391 B2
(45) Date of Patent: Nov. 2, 2021

(54) HEAT CYCLE FACILITY

(71) Applicant: IHI Corporation, Tokyo (JP)

(72) Inventors: Shogo Onishi, Tokyo (JP); Shintaro Ito, Tokyo (JP); Soichiro Kato, Tokyo (JP); Taku Mizutani, Tokyo (JP); Masahiro Uchida, Tokyo (JP); Tsukasa Saitou, Tokyo (JP); Toshiro Fujimori, Tokyo (JP); Kazuo Miyoshi, Tokyo (JP)

(73) Assignee: IHI CORPORATION, Tokyo (JP)

( * ) Notice: Subject to any disclaimer, the term of this patent is extended or adjusted under 35 U.S.C. 154(b) by 195 days.

(21) Appl. No.: 16/524,525

(22) Filed: Jul. 29, 2019

(65) Prior Publication Data

US 2019/0345847 A1 Nov. 14, 2019

Related U.S. Application Data

(63) Continuation of application No. PCT/JP2018/002896, filed on Jan. 30, 2018.

(30) Foreign Application Priority Data

Jan. 31, 2017 (JP) ..... JP2017-016233

(51) Int. Cl.
*F01K 25/10* (2006.01)
*F01K 9/00* (2006.01)
*F01K 23/04* (2006.01)

(52) U.S. Cl.
CPC ..... *F01K 25/106* (2013.01); *F01K 9/00* (2013.01); *F01K 23/04* (2013.01)

(58) Field of Classification Search
CPC ..... F01K 25/106; F01K 9/00; F01K 23/04; F01K 17/06; F01K 25/08; F01K 23/06
(Continued)

(56) References Cited

U.S. PATENT DOCUMENTS 4,503,682 A * 3/1985 Rosenblatt ..... F25B 29/006 60/671
8,783,035 B2 * 7/2014 Milam ..... F01K 25/10 60/651

(Continued)

FOREIGN PATENT DOCUMENTS

CN 1807848 A 7/2006
CN 101298843 A 11/2008

(Continued)

OTHER PUBLICATIONS

Office Action dated Jul. 13, 2021 in corresponding Chinese Patent Application No. 201880008697.3 (with an English translation) (13 pages).

(Continued)

*Primary Examiner* — Hoang M Nguyen
(74) *Attorney, Agent, or Firm* — Rothwell, Figg, Ernst & Manbeck, P.C.

(57) ABSTRACT

The heat cycle facility includes: a first vaporizer that vaporizes a first liquid heating medium by combusting fuel; a first motive power generator that generates motive power by using as a drive fluid a first gas heating medium obtained at the first vaporizer; a condenser that condenses the first gas heating medium discharged from the first motive power generator by heat-exchanging the first gas heating medium for a second liquid heating medium; a circulator that pressurizes the first liquid heating medium obtained at the condenser and supplies the pressurized first liquid heating medium to the first vaporizer; a second vaporizer that produces gaseous ammonia by heat-exchanging the second liquid heating medium for liquid ammonia; and a supplier that supplies the liquid ammonia to the second vaporizer.

8 Claims, 5 Drawing Sheets

(58) Field of Classification Search
USPC ..... 60/651, 653, 655, 670, 671, 677–680
See application file for complete search history.

(56) References Cited

U.S. PATENT DOCUMENTS

| | | | | |
|---|---|---|---|---|
| 9,038,390 | B1 * | 5/2015 | Kreuger | F03G 6/065 60/655 |
| 2001/0027642 | A1 | 10/2001 | Tsuji | |
| 2015/0143828 | A1 * | 5/2015 | Atalla | F01K 25/10 62/115 |

FOREIGN PATENT DOCUMENTS

| | | | |
|---|---|---|---|
| CN | 106931481 | A | 7/2017 |
| CN | 107789984 | A | 3/2018 |
| FR | 2215835 | A6 | 8/1974 |
| JP | 47-020673 | B | 6/1972 |
| JP | 51-091446 | A | 8/1976 |
| JP | 53-038845 | A | 4/1978 |
| JP | 04-091206 | A | 8/1992 |
| JP | 11-270352 | A | 10/1999 |
| JP | 2003-278598 | A | 10/2003 |
| JP | 2003-307348 | A | 10/2003 |
| JP | 2013-257125 | A | 12/2013 |
| JP | 2015-190466 | A | 11/2015 |
| JP | 2016-151191 | A | 8/2016 |
| JP | 2016-183839 | A | 10/2016 |

OTHER PUBLICATIONS

Shang Shaowen, "Application of Heating Ventilation Air Conditioning Technology", 2017, the last paragraph on p. 136.
Wu Yining, "Principles of Basic Environmental Chemical Engineering", 2017, paragraphs 4-6 on p. 174.

* cited by examiner

HEAT CYCLE FACILITY

CROSS-REFERENCE TO RELATED APPLICATIONS

This application is a Continuation Application based on International Application No. PCT/JP2018/002896, filed Jan. 30, 2018, which claims priority on Japanese Patent Application No. 2017-016233, filed Jan. 31, 2017, the contents of which are incorporated herein by reference.

TECHNICAL FIELD

The present disclosure relates to a heat cycle facility.

BACKGROUND

Patent Document 1 shown below discloses a combustion device and a gas turbine that combust ammonia as fuel. The combustion device and the gas turbine vaporize liquid ammonia using the heat (residual heat) of combustion exhaust gas discharged from a turbine and supply it to a combustor, thereby decreasing nitrogen oxide (NOx) while limiting the deterioration of the combustion efficiency compared to a case where liquid ammonia is simply combusted in the combustor.

Document of Related Art

Patent Document

[Patent Document 1] Japanese Unexamined Patent Application, First Publication No. 2015-190466

SUMMARY

Technical Problem

Incidentally, in the method of vaporizing liquid ammonia by heat-exchange between the liquid ammonia and combustion exhaust gas (combustion gas) discharged from the turbine according to the technology of Patent Document 1, the difference between the temperature of the combustion gas and the boiling point of the liquid ammonia is large, and thus there is a possibility of improvement in energy-using efficiency.

The present disclosure is made in view of the above circumstances, and an object thereof is to improve the heat efficiency of the system by vaporizing liquid ammonia using a heating medium having a temperature lower than that of combustion gas.

Solution to Problem

In order to obtain the above object, a heat cycle facility of a first aspect of the present disclosure includes: a first vaporizer that vaporizes a first liquid heating medium by combusting fuel to obtain a first gas heating medium; a first motive power generator that generates motive power by using as a drive fluid the first gas heating medium obtained at the first vaporizer; a condenser that condenses the first gas heating medium discharged from the first motive power generator by heat-exchanging the first gas heating medium for a second liquid heating medium to obtain the first liquid heating medium; a circulator that pressurizes the first liquid heating medium obtained at the condenser and supplies the pressurized first liquid heating medium to the first vaporizer; a second vaporizer that produces gaseous ammonia by heat-exchanging the second liquid heating medium for liquid ammonia; and a supplier that supplies the liquid ammonia to the second vaporizer.

A second aspect of the present disclosure is that in the heat cycle facility of the first aspect, the second vaporizer is configured to heat-exchange the second liquid heating medium for the liquid ammonia via a heat transfer body.

A third aspect of the present disclosure is that in the heat cycle facility of the second aspect, the heat transfer body is made of steel.

A fourth aspect of the present disclosure is the heat cycle facility of any one of the first to third aspects further including a second motive power generator that generates motive power by using as a drive fluid the gaseous ammonia produced by the second vaporizer.

A fifth aspect of the present disclosure is the heat cycle facility of the fourth aspect further including a re-heater that reheats the liquid ammonia discharged from the second motive power generator by heat-exchanging the liquid ammonia for the second liquid heating medium.

A sixth aspect of the present disclosure is the heat cycle facility of the fourth aspect further including an overheater that overheats the gaseous ammonia produced by the second vaporizer by heat-exchanging the gaseous ammonia for exhaust gas of the first vaporizer.

A seventh aspect of the present disclosure is that in the heat cycle facility of any one of the first to sixth aspects, the first vaporizer is configured to combust as the fuel the gaseous ammonia produced by the second vaporizer.

An eighth aspect of the present disclosure is the heat cycle facility of any one of the first to seventh aspects further including a denitrator that denitrifies combustion gas produced by the first vaporizer by using as a reducing agent the gaseous ammonia produced by the second vaporizer.

A ninth aspect of the present disclosure is that in the heat cycle facility of any one of the first to eighth aspects, the first liquid heating medium is water, the first vaporizer is a boiler that vaporizes the water to produce water vapor, the first motive power generator is a turbine whose drive fluid is the water vapor, and the second liquid heating medium is water or seawater.

Effects

According to the present disclosure, since the energy to be discharged to the outside of the system through the second liquid heating medium is recovered by the liquid ammonia, the heat efficiency of the system can be improved.

DESCRIPTION OF EMBODIMENTS

Hereinafter, embodiments of the present disclosure will be described with reference to the drawings.

First Embodiment

Figure 1:
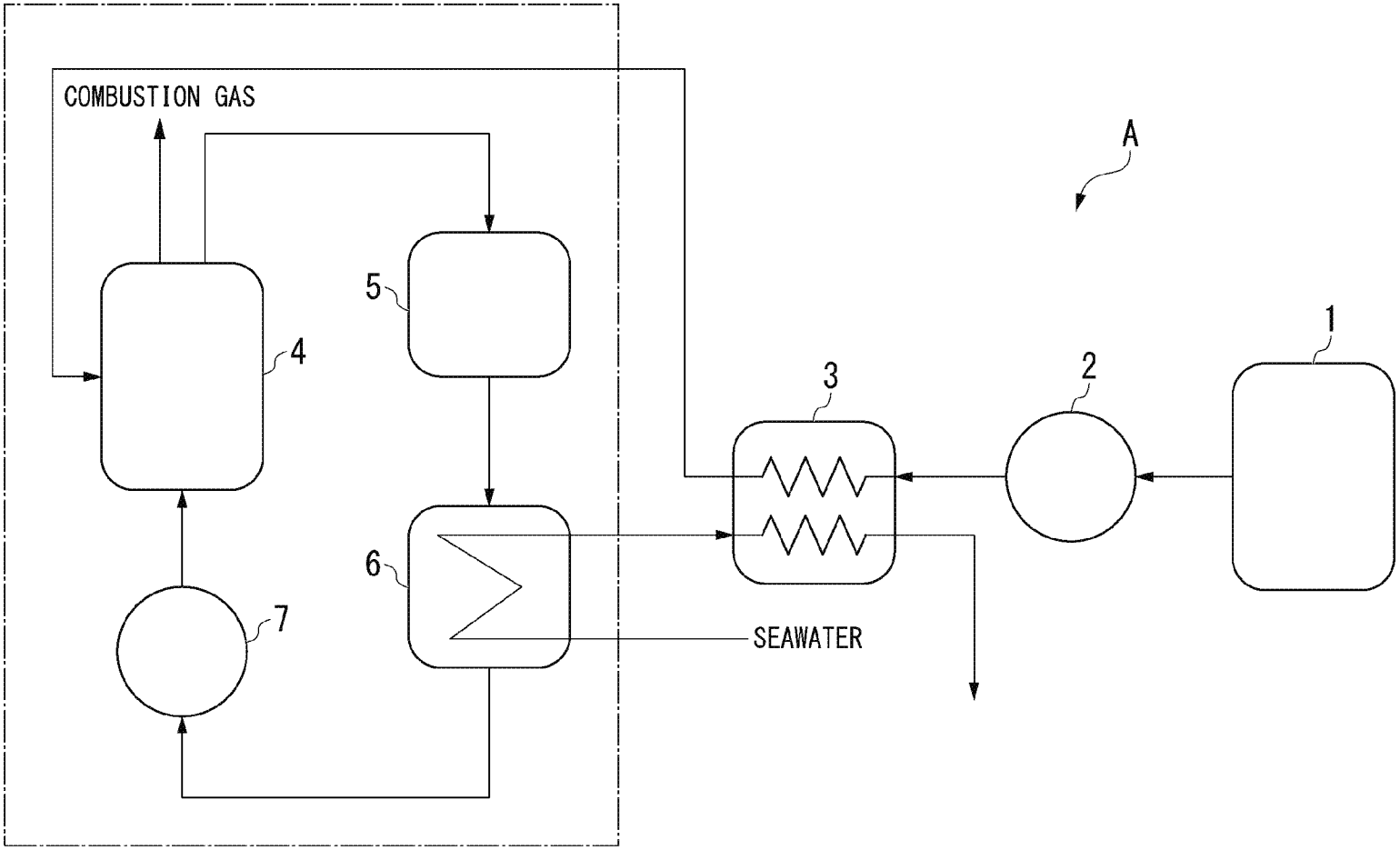
FIG. 1 is a block diagram showing a configuration of a heat cycle facility of a first embodiment of the present disclosure.

First, a first embodiment of the present disclosure will be described. As shown in FIG. 1, a heat cycle facility A of the first embodiment includes a fuel tank 1, a pump 2, a vaporizer 3, a boiler 4, a turbine 5, a condenser 6 and a pump 7. Among these components, the boiler 4, the turbine 5, the condenser 6 and the pump 7 are annularly interconnected through water pipes or steam pipes to form a Rankine cycle (heat cycle).

The pump 2 among these components corresponds to the supplier of the present disclosure. The vaporizer 3 corresponds to the second vaporizer of the present disclosure. The boiler 4 corresponds to the first vaporizer of the present disclosure. The turbine 5 corresponds to the first motive power generator of the present disclosure. The condenser 6 corresponds to the condenser of the present disclosure. The pump 7 corresponds to the circulator of the present disclosure.

The fuel tank 1 internally stores liquid ammonia as fuel. The pump 2 is connected to the fuel tank 1 through a predetermined fuel pipe, pumps out liquid ammonia from the fuel tank 1 and supplies it to the vaporizer 3.

The vaporizer 3 is connected to the pump 2 through a predetermined fuel pipe and vaporizes the liquid ammonia using warm seawater supplied separately from the condenser 6 to produce gaseous ammonia. That is, the vaporizer 3 is a kind of heat-exchanger and produces gaseous ammonia by heat-exchanging the warm water that is the second liquid heating medium for liquid ammonia. The vaporizer 3 is connected to the boiler 4 through a predetermined fuel pipe and supplies gaseous ammonia as fuel to the boiler 4. In addition, the vaporizer 3 discharges the warm seawater after heat-exchange for the liquid ammonia to the outside.

The boiler 4 is connected to the pump 7 through a water pipe and vaporizes water (the first liquid heating medium) supplied from the pump 7 by combusting as fuel the gaseous ammonia supplied from the vaporizer 3. That is, the boiler 4 combusts gaseous ammonia using combustion air taken in from the outside air as an oxidizing agent to produce combustion gas and vaporizes the water (the first liquid heating medium) by the heat energy of the combustion gas to produce water vapor (the first gas heating medium). The boiler 4 is connected to the turbine 5 through a steam pipe and outputs the water vapor to the turbine 5. That is, the boiler 4 vaporizes the first liquid heating medium by heat generated by combustion to obtain the first gas heating medium.

The turbine 5 is a steam turbine and generates rotational motive power by using the water vapor (the first gas heating medium) supplied from the boiler 4 as a drive fluid. The turbine 5 is connected to the condenser 6 through a steam pipe and discharges the water vapor after power recovery to the condenser 6.

The condenser 6 is configured to be supplied with seawater at a predetermined flow rate by a seawater pump (not shown) and condenses the water vapor (the first gas heating medium) received from the turbine 5 by using this seawater. That is, the condenser 6 cools the water vapor (the first gas heating medium) received from the turbine 5 by heat-exchange for separately received seawater (the second liquid heating medium) to return (condense) the water vapor to water (the first liquid heating medium).

The condenser 6 is connected to the pump 7 through a water pipe and supplies the water (the first liquid heating medium) to the pump 7. In addition, the condenser 6 supplies seawater (warm seawater) warmed by heat-exchange for the water vapor (the first gas heating medium) to the vaporizer 3.

The pump 7 pressurizes water (the first liquid heating medium) and supplies the pressurized water to the boiler 4. That is, in a circulation route configured of the boiler 4, the turbine 5, the condenser 6, the pump 7, the water pipes and the steam pipes, the pump 7 is a power source for circulating water (the first liquid heating medium) and water vapor (the first gas heating medium) in the direction of the arrow shown in FIG. 1.

Although not shown, the turbine 5 rotationally drives an electric generator by its own rotational motive power. That is, the heat cycle facility A of the first embodiment obtains electric power as a final acquisition by using the Rankine cycle (heat cycle). Note that the first motive power generator of the present disclosure may be used for other than the driving source for the electric generator.

Next, the operation of the heat cycle facility A of the first embodiment will be described in detail.

In the heat cycle facility A, liquid ammonia pumped out from the fuel tank 1 is phase-changed into gaseous ammonia, which is supplied to the boiler 4, by the operation of the pump 2 and the vaporizer 3. In addition, separately from this, water is supplied to the boiler 4 by the operation of the pump 7.

Then, the boiler 4 vaporizes the water separately supplied from the pump 7 by combusting the gaseous ammonia supplied from the vaporizer 3 as fuel to produce water vapor.

Then, the turbine 5 generates rotational motive power by using the water vapor supplied from the boiler 4 as a drive fluid. For example, when an electric generator is axially connected to the turbine 5, the rotational motive power of the turbine 5 is used to drive the electric generator and is converted to electric power. Then, the water vapor discharged from the turbine 5 is condensed by heat-exchange for seawater in the condensate 6 into water, which is supplied to the pump 7.

In the heat cycle facility A, rotational motive power is generated by water repeating the phase-transition between the liquid phase and the gas phase. Further, in the heat cycle facility A, the heat of seawater to be discharged to the outside is recovered as energy for vaporizing and heating liquid ammonia. Therefore, according to the heat cycle facility A, the heat efficiency of the system can be improved.

Figure 2:
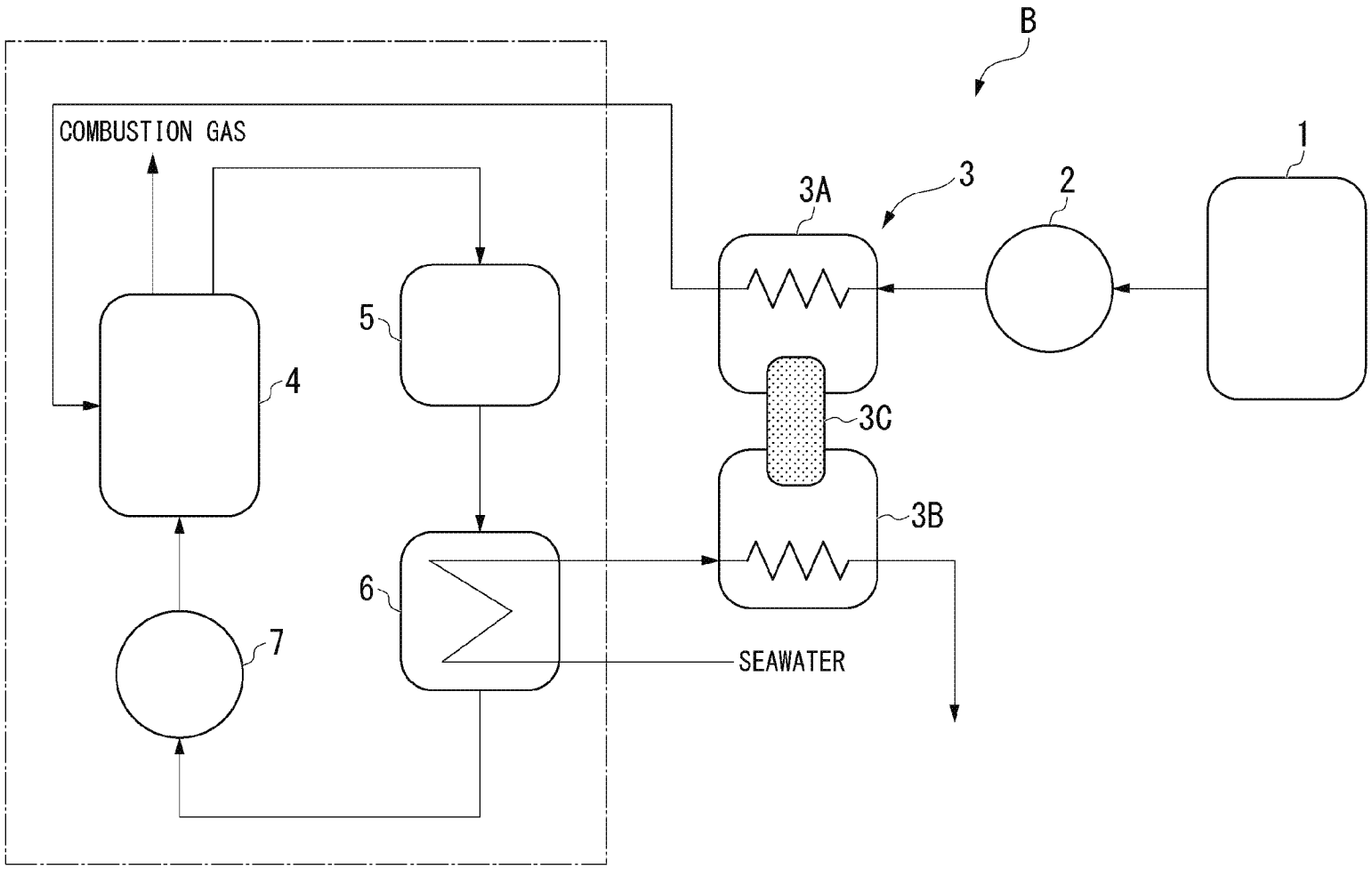
FIG. 2 is a block diagram showing a configuration of a heat cycle facility of a modification of the first embodiment of the present disclosure.

FIG. 2 shows a heat cycle facility B of a modification of the first embodiment. In the heat cycle facility B, the above vaporizer 3 (the second vaporizer) is configured of an ammonia heat transferer 3A, a seawater heat transferer 3B and a heat transfer plate 3C.

The ammonia heat transferer 3A is a heat transfer passageway through which ammonia (liquid ammonia and gaseous ammonia) flows, and the seawater heat transferer 3B is a heat transfer passageway through which seawater flows. The heat transfer plate 3C is a member (plate member) for thermally connecting the ammonia heat transferer 3A and the seawater heat transferer 3B and connects the ammonia heat transferer 3A and the seawater heat transferer 3B so as to be heat transferable. The heat transfer plate 3C corresponds to the heat transfer body of the present disclosure.

The corrosiveness to materials is different between ammonia (liquid ammonia and gaseous ammonia) and seawater (the second liquid heating medium). For example, steel materials have sufficient corrosion resistance to ammonia, but have poor corrosion resistance to seawater. Therefore, although the flow passageway for ammonia may be made of steel, the flow passageway for seawater may be made of a material other than steel, such as titanium alloy. Under such circumstances, in the heat cycle facility of this modification, the ammonia heat transferer 3A and the seawater heat transferer 3B are formed of different materials in consideration of corrosion resistance. For example, the ammonia heat transferer 3A and the heat transfer plate 3C are formed of carbon steel (steel material), and the seawater heat transferer 3B is formed of titanium alloy.

According to the heat cycle facility B including the ammonia heat transferer 3A, the seawater heat transferer 3B and the heat transfer plate 3C, in addition to the effects obtained by the heat cycle facility A of the first embodiment described above, the corrosion resistance of the second vaporizer can be improved compared to that of the heat cycle facility A of the first embodiment.

Second Embodiment

Figure 3:
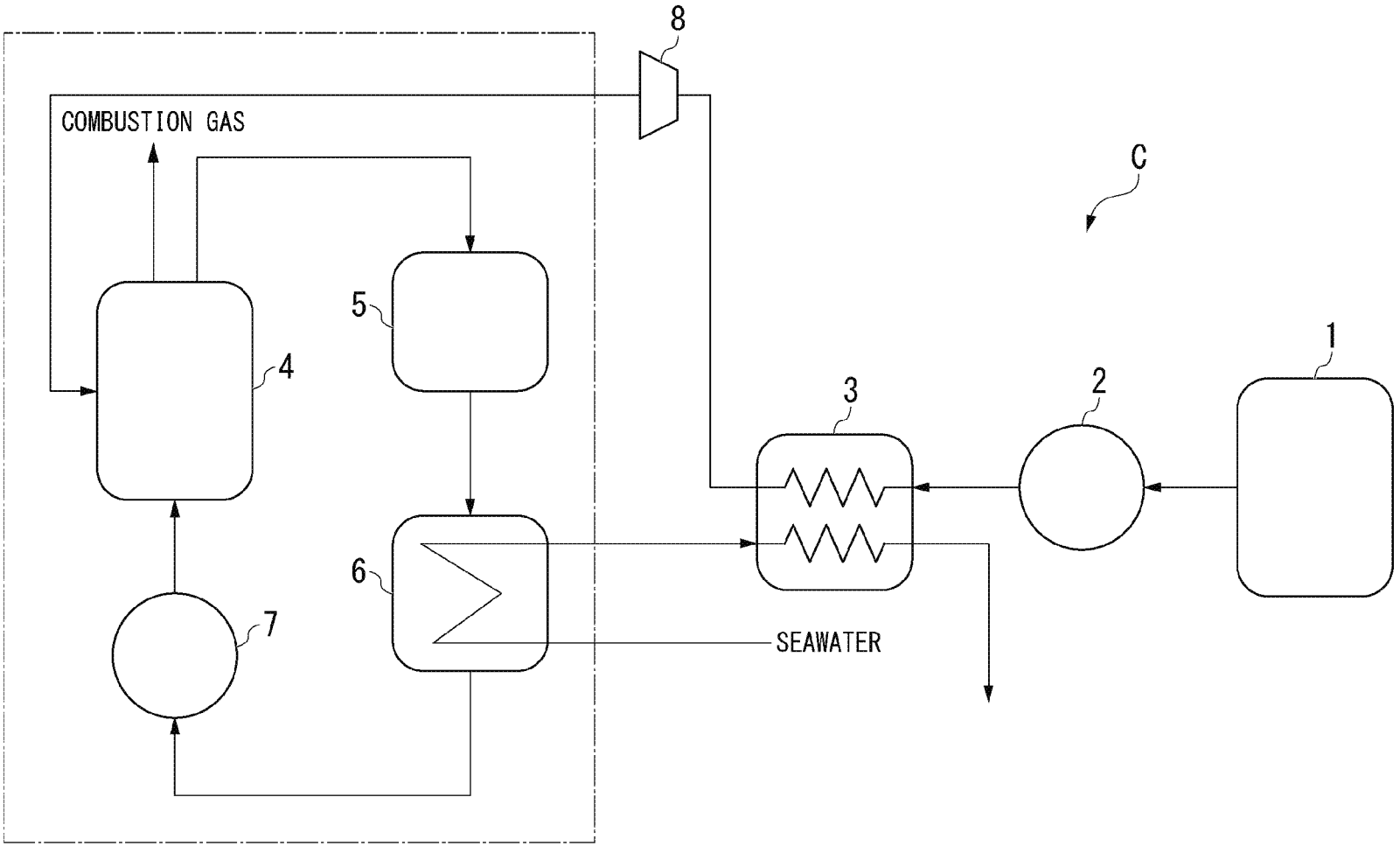
FIG. 3 is a block diagram showing a configuration of a heat cycle facility of a second embodiment of the present disclosure.

Next, a second embodiment of the present disclosure will be described with reference to FIG. 3. A heat cycle facility C of the second embodiment has a configuration in which an expansion cycle of ammonia is combined with the Rankine cycle, and an expansion turbine 8 is added to the heat cycle facility A shown in FIG. 1.

In the heat cycle facility C, an expansion cycle of ammonia is configured of the vaporizer 3 and the expansion turbine 8. Note that the expansion turbine 8 corresponds to the second motive power generator of the present disclosure.

That is, by providing the expansion turbine 8 between the vaporizer 3 and the boiler 4, the heat cycle facility C drives the expansion turbine 8 using the gaseous ammonia produced by the vaporizer 3. In the heat cycle facility C, the gaseous ammonia after power recovery by the expansion turbine 8 is supplied as fuel to the boiler 4 to produce water vapor.

In the heat cycle facility C, rotational motive power is not generated only by the turbine 5 but is also generated by the expansion turbine 8. Therefore, according to the heat cycle facility C, in addition to the effects obtained by the heat cycle facilities A and B described above, it is possible to generate greater motive power than those of the heat cycle facilities A and B. For example, by driving an electric generator using the rotational motive power generated by the turbine 5, and by driving another electric generator using the rotational motive power generated by the expansion turbine 8, it is possible to generate greater electric power than the heat cycle facilities A and B.

Figure 4:
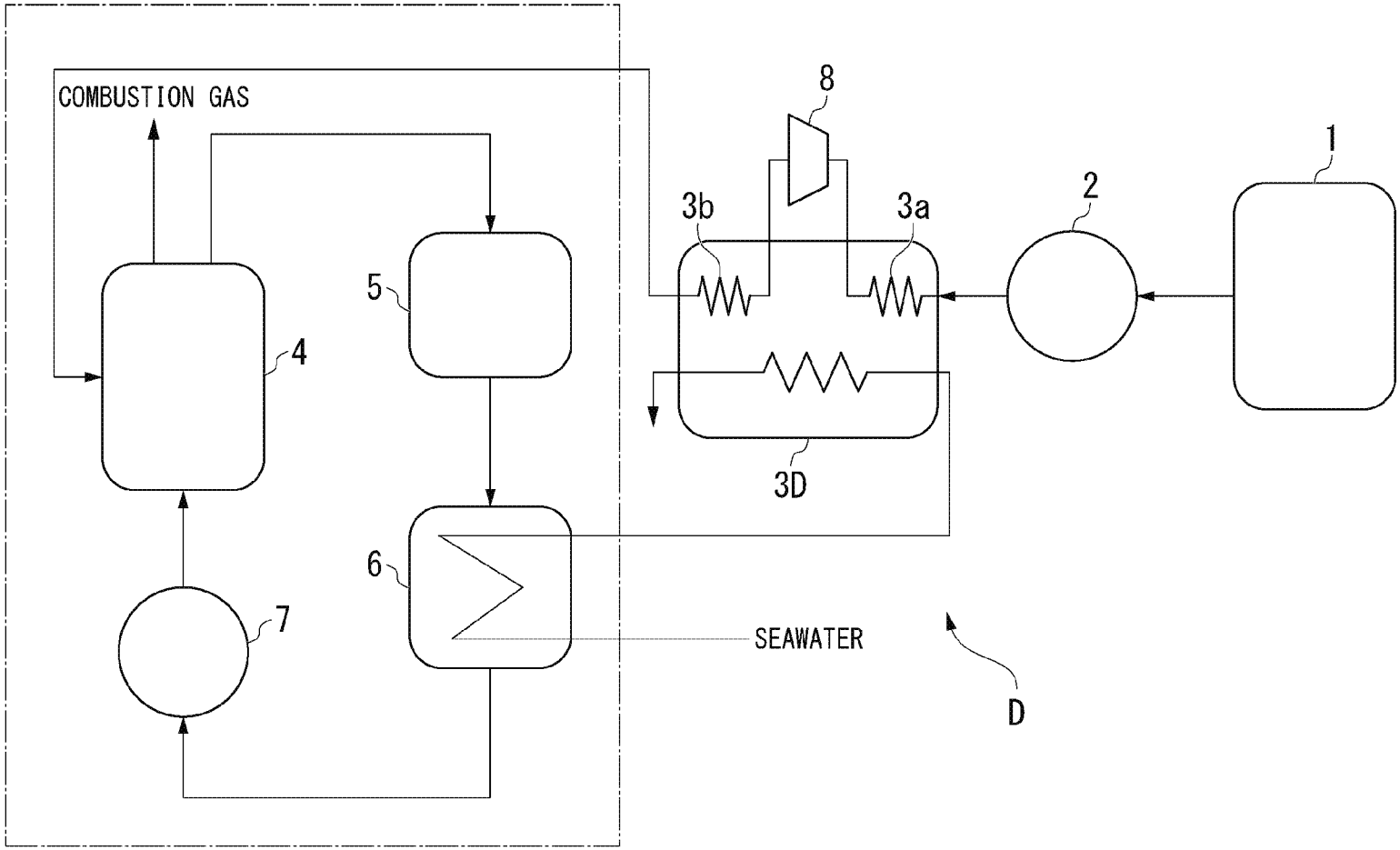
FIG. 4 is a block diagram showing a configuration of a heat cycle facility of a first modification of the second embodiment of the present disclosure.

FIG. 4 shows a heat cycle facility D of a first modification of the second embodiment.

The heat cycle facility D includes a vaporizer 3D (the second vaporizer) provided with two heat transferers relating to ammonia (a first heat transferer 3*a* and a second heat transferer 3*b*), instead of the vaporizer 3. In addition, in the vaporizer 3D, the seawater supplied from the condenser 6 is first heat-exchanged for the liquid ammonia passing through the first heat transferer 3*a* and then is heat-exchanged for the liquid ammonia passing through the second heat transferer 3*b*.

In the heat cycle facility D, the expansion turbine 8 is provided between the first heat transferer 3*a* and the second heat transferer 3*b*. The first heat transferer 3*a* produces gaseous ammonia by heat-exchanging liquid ammonia supplied from the pump 2 for seawater. The expansion turbine 8 is driven by the gaseous ammonia supplied from the first heat transferer 3*a* to generate rotational motive power.

Gaseous ammonia is decreased in temperature and pressure by being deprived of heat energy by the expansion turbine 8 and is partially liquefied in some cases. The second heat transferer 3*b* is a re-heater that reheats and revaporizes ammonia (partially liquefied) supplied from the expansion turbine 8 by heat-exchanging the ammonia for seawater. The gaseous ammonia produced by the second heat transferer 3*b* is supplied to the boiler 4 as fuel.

According to the heat cycle facility D having the above configuration, in addition to the rotational motive power generated by the turbine 5, rotational motive power can also be obtained by the expansion turbine 8, whereby it is possible to generate greater electric power than the heat cycle facilities A and B described above.

Figure 5:
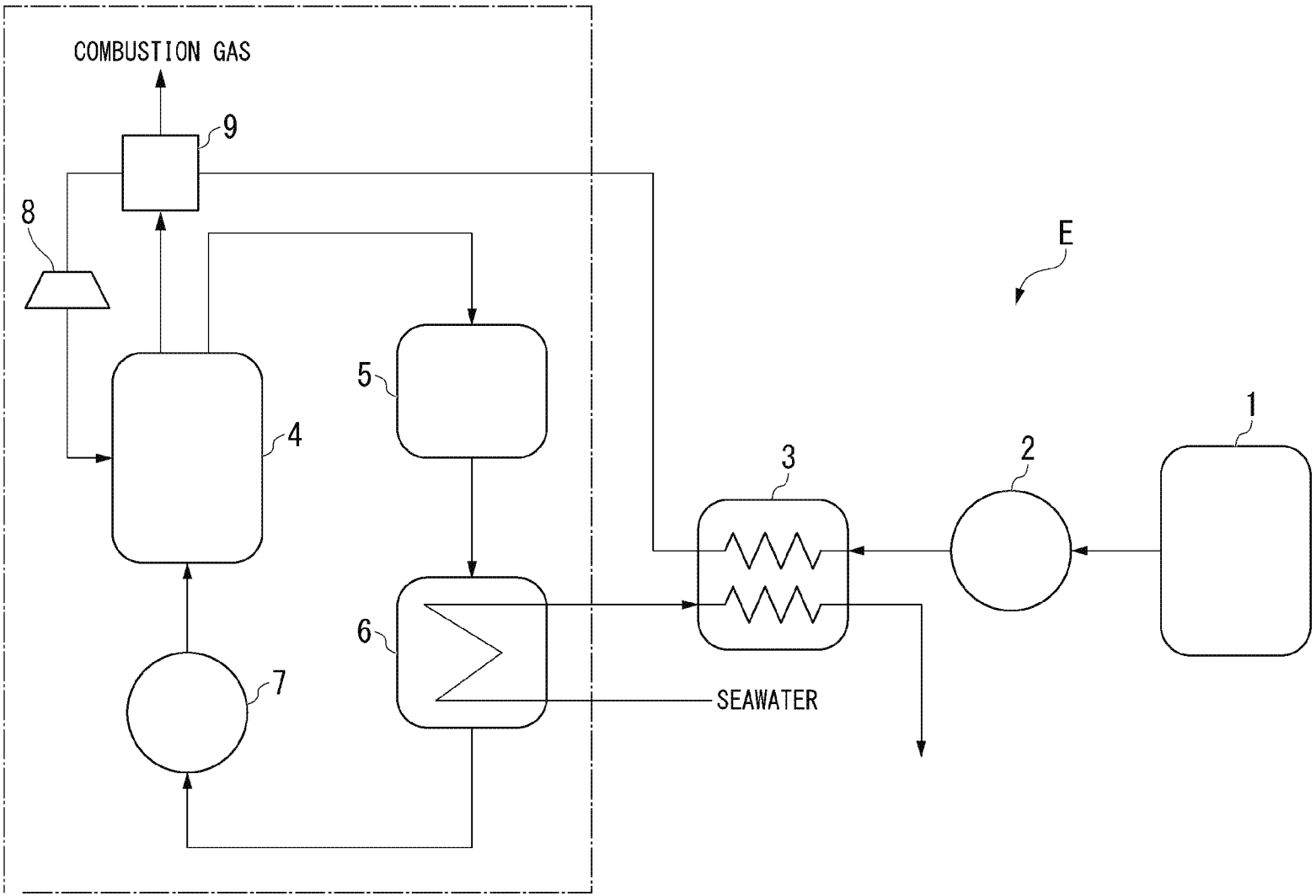
FIG. 5 is a block diagram showing a configuration of a heat cycle facility of a second modification of the second embodiment of the present disclosure.

Furthermore, FIG. 5 shows a heat cycle facility E of a second modification of the second embodiment. In the heat cycle facility E, a heat-exchanger 9 is added to the heat cycle facility C described above.

That is, in the heat cycle facility E, the heat-exchanger 9 that heat-exchanges gaseous ammonia for the combustion gas (exhaust gas) of the boiler 4 is provided between the vaporizer 3 and the expansion turbine 8. The heat-exchanger 9 serves as an overheater that overheats the gaseous ammonia produced by the vaporizer 3 by heat-exchanging the gaseous ammonia for the combustion gas (exhaust gas) of the boiler 4.

According to the heat cycle facility E having the above configuration, since the temperature of gaseous ammonia to be supplied to the boiler 4 can be increased compared to the heat cycle facility C described above, the flammability of the gaseous ammonia in the boiler 4 can be improved, and the temperature of the exhaust gas can be decreased, and thus the heat efficiency of the heat cycle facility E can be improved.

Hereinbefore, the embodiments of the present disclosure are described with reference to the attached drawings, but the present disclosure is not limited to the above embodiments. The shapes, combinations and the like of the components described in the above embodiments are merely examples, and addition, omission, replacement, and other modifications of the configuration can be adopted based on design requirements and the like within the scope of the present disclosure. For example, the following modifications can be considered.

(1) In each of the above embodiments, a case is described where gaseous ammonia produced by heat-exchange for seawater (the second liquid heating medium) is used as fuel for the boiler 4, but the present disclosure is not limited thereto. For example, the heat cycle facility of the present disclosure may further include a denitrator that denitrifies the combustion gas produced at the first vaporizer by using as a reducing agent the gaseous ammonia produced by the second vaporizer.

That is, the combustion gas (exhaust gas) of the boiler 4 is generally denitrified to remove nitrogen oxide (NOx) therefrom, and ammonia is used as the reducing agent for this denitrification treatment. Under these circumstances, in addition to using gaseous ammonia as fuel for the boiler 4, or instead of using gaseous ammonia as fuel for the boiler 4, gaseous ammonia may be used as the reducing agent for the denitrator.

(2) In each of the above embodiments, the Rankine cycle is configured of the boiler 4, the turbine 5, the condenser 6 and the pump 7, but the present disclosure is not limited thereto. For example, another first vaporizer that combusts gaseous ammonia (the first liquid heating medium) to produce the first gas heating medium may be adopted instead of the boiler 4, and another motive power generator that generates motive power using the first gas heating medium may be adopted instead of the turbine 5. In this case, another first liquid heating medium may be adopted instead of water.

(3) In each of the above embodiments, seawater is used as the second liquid heating medium, but the present disclosure is not limited thereto. For example, water (fresh water) introduced from a river, a lake or the like may be used therefor instead of seawater.

(4) In each of the above embodiments, the gaseous ammonia is combusted as single fuel at the boiler 4, but the present disclosure is not limited thereto. Fuel other than gaseous ammonia may be mixed with gaseous ammonia and be combusted, or fuel other than gaseous ammonia may be solely combusted. As fuel other than gaseous ammonia, for example, coal (pulverized coal) and various biomass fuels can be considered.

(5) In each of the above embodiments, water (the first liquid heating medium) is phase-transferred into water vapor (the first gas heating medium) only by the combustion heat of the boiler 4, but the present disclosure is not limited thereto. For example, natural energy and the combustion heat of the boiler 4 may be used in combination to cause the first liquid heating medium to phase-transition to the first gas heating medium.

What is claimed is:

1. A heat cycle facility comprising:

a first vaporizer that vaporizes a first liquid heating medium by combusting fuel to obtain a first gas heating medium;

a first motive power generator that generates motive power by using as a drive fluid the first gas heating medium obtained at the first vaporizer;

a condenser that condenses the first gas heating medium discharged from the first motive power generator by heat-exchanging the first gas heating medium for a second liquid heating medium to obtain the first liquid heating medium;

a circulator that pressurizes the first liquid heating medium obtained at the condenser and supplies the pressurized first liquid heating medium to the first vaporizer;

a second vaporizer that produces gaseous ammonia by heat-exchanging the second liquid heating medium for liquid ammonia; and a supplier that supplies the liquid ammonia to the second vaporizer, wherein the second vaporizer includes: a titanium alloy-formed heat transfer passageway through which the second liquid heating medium flows; a carbon steel-formed heat transfer passageway through which the liquid ammonia flows; and a heat transfer plate configured to thermally connect the titanium alloy-formed heat transfer passageway and the carbon steel-formed heat transfer passageway.

2. The heat cycle facility according to claim 1, further comprising:

a second motive power generator that generates motive power by using as a drive fluid the gaseous ammonia produced by the second vaporizer.

3. The heat cycle facility according to claim 2, further comprising:

a re-heater that reheats the liquid ammonia discharged from the second motive power generator by heat-exchanging the liquid ammonia for the second liquid heating medium.

4. The heat cycle facility according to claim 2, further comprising:

an overheater that overheats the gaseous ammonia produced by the second vaporizer by heat-exchanging the gaseous ammonia for exhaust gas of the first vaporizer.

5. The heat cycle facility according to claim 1, further comprising:

an overheater that overheats the gaseous ammonia produced by the second vaporizer by heat-exchanging the gaseous ammonia for exhaust gas of the first vaporizer.

6. The heat cycle facility according to claim 1, wherein the first vaporizer is configured to combust as the fuel the gaseous ammonia produced by the second vaporizer.

7. The heat cycle facility according to claim 1, further comprising:

a denitrator that denitrifies combustion gas produced by the first vaporizer by using as a reducing agent the gaseous ammonia produced by the second vaporizer.

8. The heat cycle facility according to claim 1, wherein the first liquid heating medium is water, the first vaporizer is a boiler that vaporizes the water to produce water vapor, the first motive power generator is a turbine whose drive fluid is the water vapor, and the second liquid heating medium is water or seawater.

* * * * *